US006367966B1

(12) United States Patent
Hara

(10) Patent No.: US 6,367,966 B1
(45) Date of Patent: Apr. 9, 2002

(54) TIMEPIECE

(75) Inventor: Tatsuo Hara, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/600,577

(22) PCT Filed: Nov. 29, 1999

(86) PCT No.: PCT/JP99/06670

§ 371 Date: Jul. 19, 2000

§ 102(e) Date: Jul. 19, 2000

(87) PCT Pub. No.: WO00/33143

PCT Pub. Date: Jun. 8, 2000

(30) Foreign Application Priority Data

Nov. 27, 1998 (JP) ..... 10-337387
Aug. 18, 1999 (JP) ..... 11-231747

(51) Int. Cl.[7] ..... G04B 1/10; G04B 17/00; G04B 1/00

(52) U.S. Cl. ..... 368/140; 368/184; 368/204

(58) Field of Search ..... 368/139.1, 140, 368/168, 184, 204, 220

(56) References Cited

U.S. PATENT DOCUMENTS 3,901,018 A 8/1975 Erard

FOREIGN PATENT DOCUMENTS

| | | |
|---|---|---|
| EP | 0 905 587 | 3/1999 |
| JP | 48-17014 | 5/1973 |
| JP | 50-28866 | 3/1975 |
| JP | 51-61868 | 5/1976 |
| JP | 8-5758 | 12/1996 |
| JP | 11-160463 | 6/1999 |

*Primary Examiner*—Vit Miska

(57) ABSTRACT

A fourth wheel 8 disposed in a torque transmission path and to which a second hand is mounted includes a pinion 8*a* and a gear 8*b*. Therefore, when the gear 8*b* engages a fifth-wheel first intermediate wheel 9, the diametrical dimension from a center of rotation of the fourth wheel 8 to a portion where it engages the fifth-wheel first intermediate wheel 9 can be made large, so that, even when the fourth wheel 8 is decentered, the amount by which the second hand gets shifted can be made small by making the effects of the decentering at the center-of-rotation side small. In addition, since the fourth wheel 8 is disposed so as not to overlap a mainspring 1*a*, the width of the mainspring 1*a* can be made correspondingly small. Thus, the length of time a timepiece continues operating can be increased by increasing the torque of the mainspring 1*a* without increasing the thickness of the entire timepiece.

38 Claims, 13 Drawing Sheets

TIMEPIECE

TECHNICAL FIELD

The present invention relates to a mechanical timepiece which operates by using as a driving source mechanical energy generated when a mainspring is released. In addition, the present invention relates to an electronic controlling type mechanical timepiece in which a portion of the mechanical energy of the mainspring is converted into electrical energy, and a rotation controlling means is operated by the electrical energy in order to control a period of rotation.

BACKGROUND ART

An electronic controlling type mechanical timepiece shown in FIG. 16 is known, in which a mainspring used as an energy source drives a wheel train, and electrical power is generated by a generator rotated as a result of receiving the rotational motion from the wheel train in order to drive an electronic circuit which controls the period of rotation of the generator, whereby the wheel train is braked to regulate the speed.

In the electronic controlling type mechanical timepiece, rotation of a movement barrel 1 in which a mainspring 1*a* is accommodated is transmitted to a second wheel 6 to which a minute hand (not shown) is mounted, after which the rotation is transmitted successively to a third wheel 7, a fourth wheel 8, a fifth wheel 11, a sixth wheel 12, and ultimately to a rotor 13 of the generator. A second pinion wheel 90 to which a second hand (not shown) is attached meshes only with the third wheel 7, so that it is situated outside a torque transmission path extending from the movement barrel 1 to the rotor 13. In order to reduce unsteady movement of the second hand caused by backlash between the third wheel 7 and the second pinion wheel 90, a second regulating spring with a suitable structure is sometimes provided.

In such an electronic controlling type mechanical timepiece, the speed of the rotor 13 is stably regulated, and, when the wheels 6, 7, 8, 11, and 12, and the second pinion wheel 90 are formed with ideal shapes, the second pinion wheel 90, that is, the second hand moves exactly at a constant speed of 1 rpm.

However, there are variations in the shapes of the wheels 6, 7, 8, 11, and 12 and the second pinion wheel 90, so that, when, in particular, the second pinion wheel 90 with a small pitch circle is decentered from its axis of rotation, the rotational speed of the second pinion wheel 90 will not be 1 rpm, causing the second hand to shift.

To overcome this problem, the pitch circle size of the second pinion wheel 90 may be made larger. However, in such a case, since the speed-increase ratio (which is, in general, 60) from the second wheel 6 to the fourth wheel 8 needs to be maintained, a teeth-shaped module of the second pinion wheel 90 is made large, making it necessary to either make the third wheel 7 larger or increase the speed-increase ratio between the second wheel 6 and the third wheel pinion. This reduces the meshing efficiency.

FIG. 15 illustrates a graph showing the measured shift angles of the hand of the conventional electronic controlling type mechanical timepiece. In the timepiece, since a large speed-increase ratio in which the second pinion wheel 90 rotates nine times during the time the third wheel 7 rotates once is set, the pitch circle of the second pinion wheel 90 becomes small, so that the decentering of the second pinion wheel 90 greatly affects the shift angle of the hand. It has been confirmed that, during the time the second pinion wheel 90 rotates nine times, the second hand is greatly shifted by an angle in the range of from −1.2° to +4° from its normal position in a circumferential direction thereof.

The electronic controlling type timepiece uses the mechanical energy of the mainspring as a driving source, so that the larger the width of the mainspring (that is, the width of the timepiece in the thickness direction thereof), the longer the timepiece will continue operating.

However, forming the mainspring with a large thickness increases the thickness of the timepiece, thereby preventing the formation of a thin timepiece.

This problem not only exists in electronic controlling type mechanical timepieces, but also in conventional mechanical timepieces in which a wheel train is driven by a mainspring.

OBJECT OF THE INVENTION

Accordingly, it is an object of the present invention to provide a timepiece which makes it possible to reduce the amount by which a second hand is shifted, and which can continue operating for a longer time without increasing the thickness of the entire timepiece.

DISCLOSURE OF THE INVENTION

A timepiece according to one aspect of the present invention includes a speed-regulating device for regulating a speed of rotation of a wheel train, in which a mainspring serving as an energy source drives the wheel train, wherein, of wheels of the wheel train, a wheel to which a second hand is mounted is disposed so that torque of the mainspring is transmitted to the speed-regulating device, the wheel to which the second hand is mounted including a pinion and a gear provided on a same axis of rotation, and being disposed so as not to overlap the mainspring when viewed in a plane.

In this invention, the wheel to which the second hand is attached includes a pinion and a gear, so that, by engaging a wheel disposed towards the mainspring and the pinion, and engaging this gear with a next gear (disposed towards the speed-regulating device), the diametrical dimension from the center of rotation of the wheel to which the second hand is attached to a portion where it engages the next gear can be made large without changing the speed-increase ratio from the mainspring side. Therefore, even if the wheel to which the second hand is attached gets decentered, the effects of the decentering at the center-of-rotation side becomes small, so that the amount by which the second hand gets shifted is reduced.

In addition, since the wheel to which the second hand is attached is disposed so as not to overlap the mainspring, the width of the mainspring can be correspondingly increased, so that the torque of the mainspring becomes large even if the thickness of the entire timepiece is not increased, thereby increasing the length of time the timepiece continues operating.

Due to the above, the above-described object is achieved.

The speed-regulating device may be constructed so as to regulate the speed of rotation of the wheel train by controlling a period of rotation of the generator by an electronic circuit driven by electrical power generated by the generator to which a rotational force from the wheel train has been applied.

Although, as in a mechanical timepiece, the speed-regulating device may comprise an escapement, the speed of the wheel train can be more precisely regulated when the electronic controlling type structure of the present invention is used.

It is desirable that the wheel to which the second hand is mounted and a gear of a barrel drum which accommodates the mainspring overlap each other when viewed in a plane.

In this structure, since the outside diameter of the gear of the barrel drum can be made large, the speed-increase ratio between it and a wheel at the wheel train side which engages the gear becomes large. Thus, the winding down of the mainspring when the train wheel is rotating at a constant speed can be slowed down, thereby increasing the length of time the timepiece continues operating.

A timepiece according to another aspect of the present invention in which a mainspring serving as an energy source drives a wheel train, and in which a speed of rotation of the wheel train is regulated by controlling a period of rotation of a generator by an electronic circuit driven by electrical power generated by the generator which has received a rotational force from the wheel train, wherein, of wheels of the wheel train, a wheel to which a second hand is mounted is disposed so that torque of the mainspring is transmitted to the generator, the wheel to which the second hand is mounted including a pinion and a gear provided on a same axis of rotation; and wherein the wheel train is disposed so as not to overlap a coil of the generator when viewed in a plane.

In the present invention, since the wheel to which the second hand is attached includes a pinion and a gear, the amount by which the second hand shifts can similarly be reduced.

In addition, since the wheel train is disposed so as not to overlap the coil, the number of windings can be increased based on a corresponding increase in the diametrical dimension of the coil, so that the axial length of the coil, and, hence, the magnetic path length becomes shorter. Consequently, iron loss such as hysteresis loss or eddy current loss occurring when a magnetic field is generated in the coil is reduced, making it possible to operate the timepiece with a smaller amount of mainspring energy, so that the timepiece can continue operating for a longer period of time.

Due to the above, the above-described object is achieved.

It is preferable that a pitch circle diameter of the gear of the wheel to which the second hand is mounted be at least 1.5 mm.

This is because, when the pitch circle diameter of the gear of the wheel is less than 1.5 mm, the effects of decentering cannot be made sufficiently small, so that effective reduction in the amount by which the hand shifts cannot be expected when the pitch circle diameter is less than 1.5 mm.

It is preferable that a barrel drum which accommodates the mainspring be supported in a cantilever fashion to a main plate.

In such a case, the barrel drum (or the barrel arbor) is supported by the main plate alone, so that, when a wheel train bridge is disposed so as not to interfere with the barrel drum by, for example, not forming a portion of the wheel train bridge at a location which corresponds to that of the barrel drum, the wheel train bridge can be disposed closer to the main plate side, making it possible to make the timepiece thinner. On the other hand, instead of bringing the train wheel bridge closer to the main plate, the width of the mainspring can be made large in order to increase the length of time the timepiece continues operating.

A wheel which engages the wheel to which the second hand is mounted and which is disposed towards the generator in a mainspring torque transmission system path may have one end side axially supported by a wheel train bridge and the other end side axially supported by a second wheel bridge disposed between the main plate and the wheel train bridge.

In this case, it is not necessary to axially support the shaft of the wheel located towards the generator by the main plate and the train wheel bridge, so that the wheel is disposed so as not to interfere with, for example, the minute hand wheel (that is, the second wheel). Therefore, it is possible to reliably transmit the torque of the mainspring to the rotor by engaging the gear of the wheel to which the second hand is mounted with a next wheel, without increasing more than necessary the size of the gear of the wheel to which the second hand is attached.

Here, the wheel disposed towards the generator in the mainspring torque transmission system path may be an idle wheel which does not increase or decrease in speed. In this case, the wheel is thinner than the wheel including the pinion and the gear.

A wheel located closer to the mainspring than a wheel which engages a rotor of the generator in the mainspring torque transmission system path may have one end side axially supported by the second wheel bridge disposed between the main plate and the train wheel bridge and the other end side axially supported by the main plate.

In this case, it is not necessary to axially support the wheel located towards the mainspring by the main plate and the train wheel bridge, so that the wheel train can be disposed in a smaller space without the axis of rotation of the wheel being interfered with, making it possible to make the timepiece smaller.

BEST MODE FOR CARRYING OUT THE INVENTION

Hereunder, a description of each of the embodiments will be given with reference to the drawings.

[First Embodiment]

Figure 1:
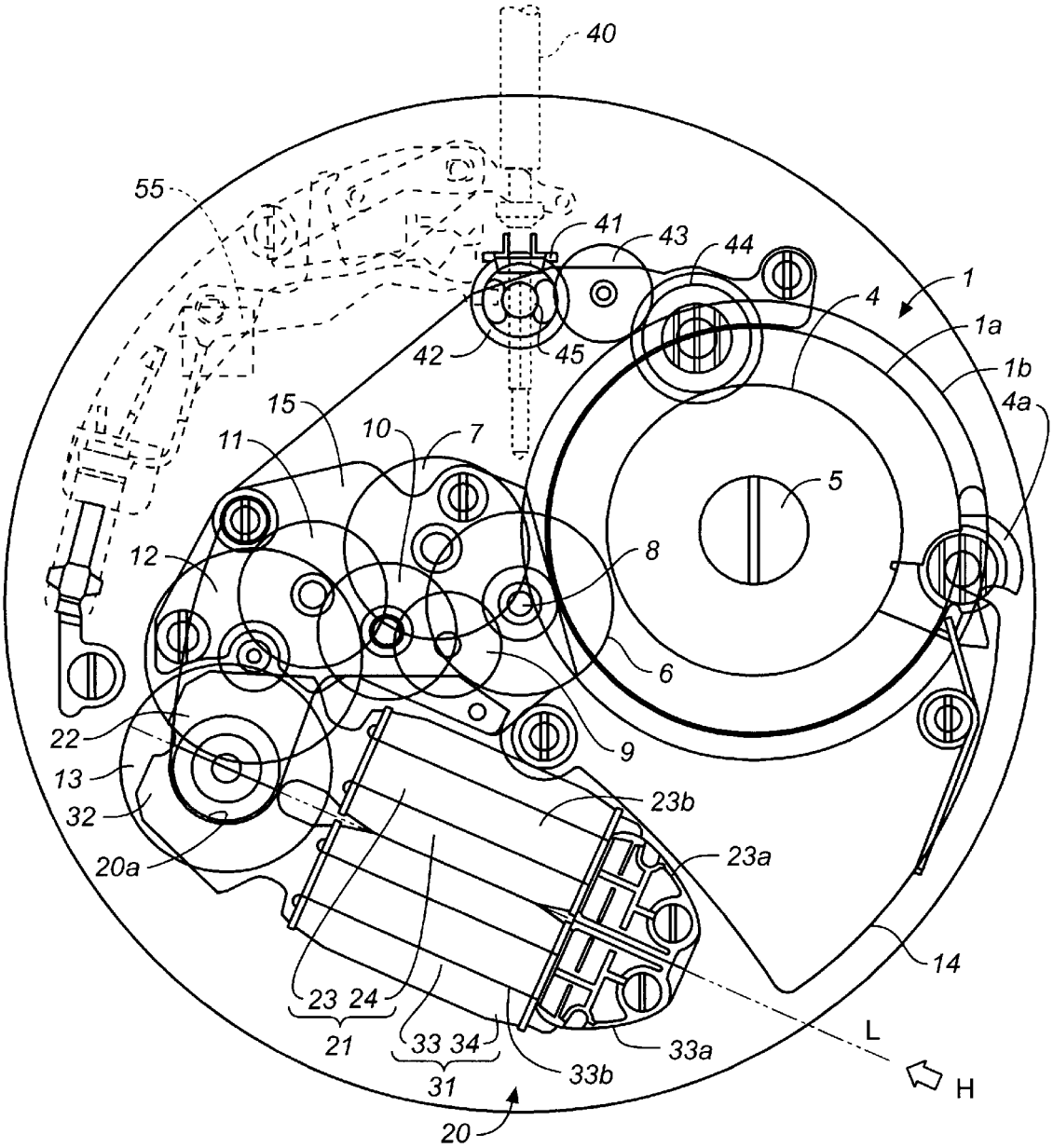
FIG. 1 is a plan view schematically showing a first embodiment of the electronic controlling type mechanical timepiece in accordance with the present invention.
Figure 2:
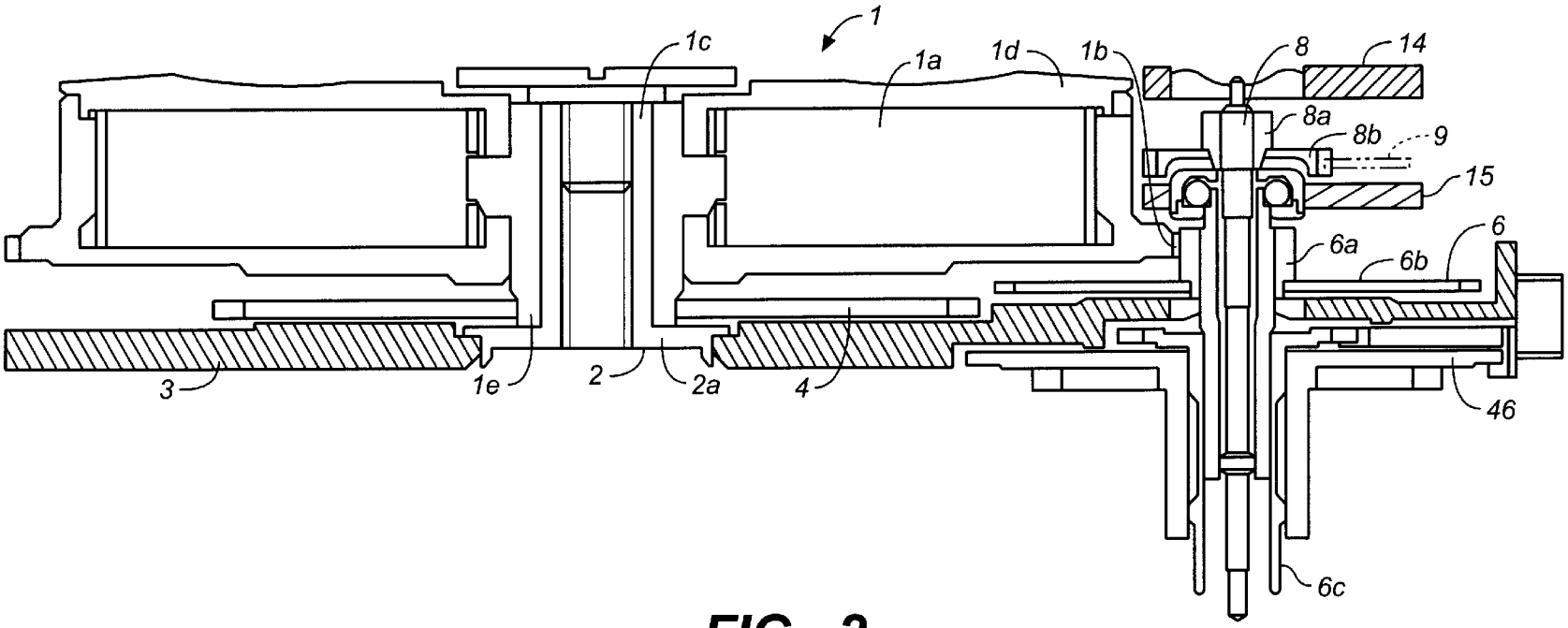
FIG. 2 is a sectional view of the main portion of the first embodiment.
Figure 3:
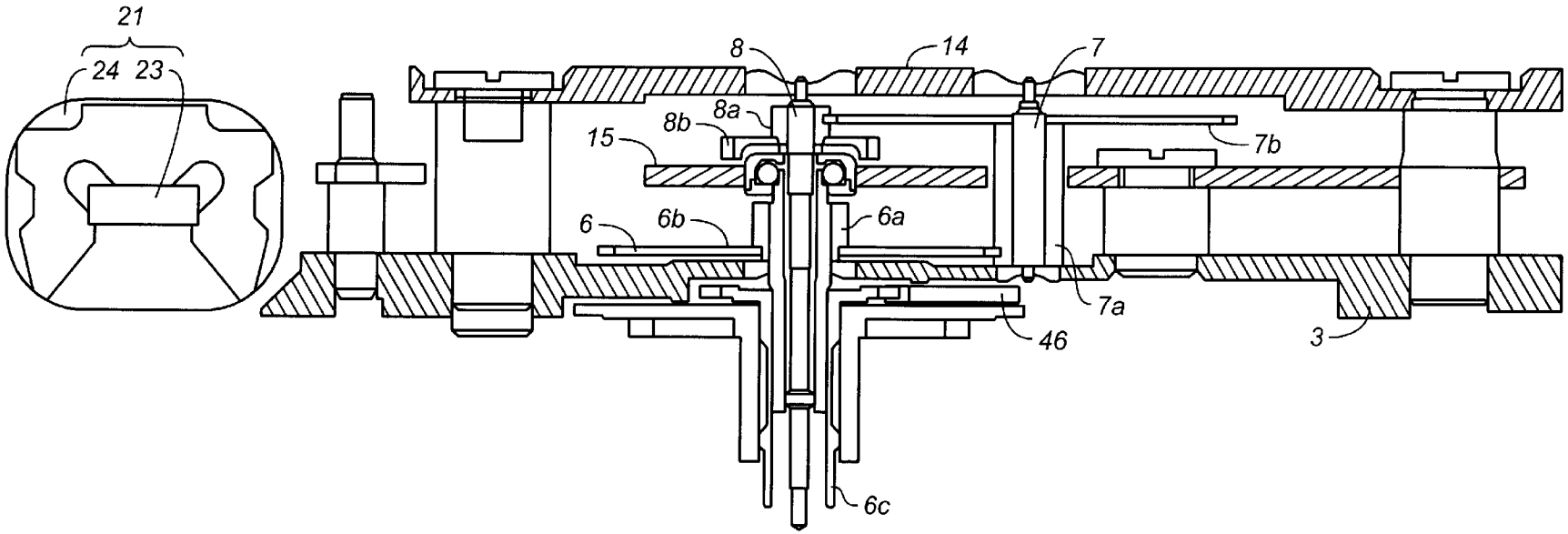
FIG. 3 is another sectional view of the main portion of the first embodiment.
Figure 4:
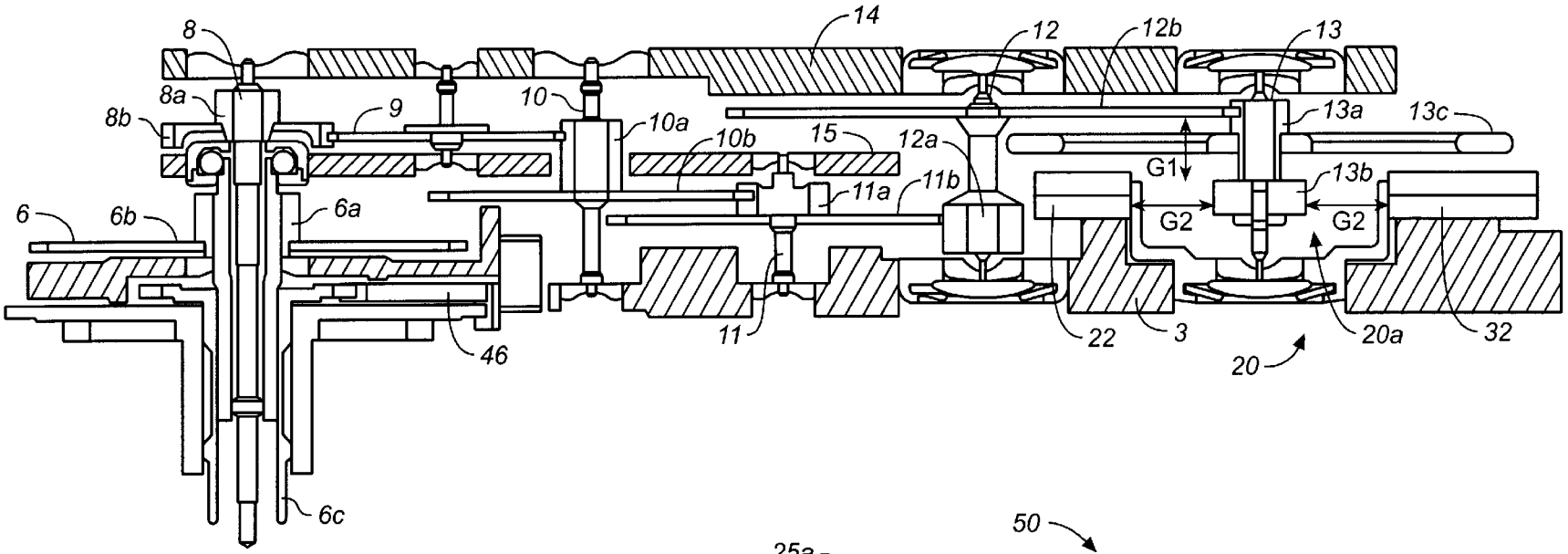
FIG. 4 is still another sectional view of the main portion of the first embodiment.
Figure 16:
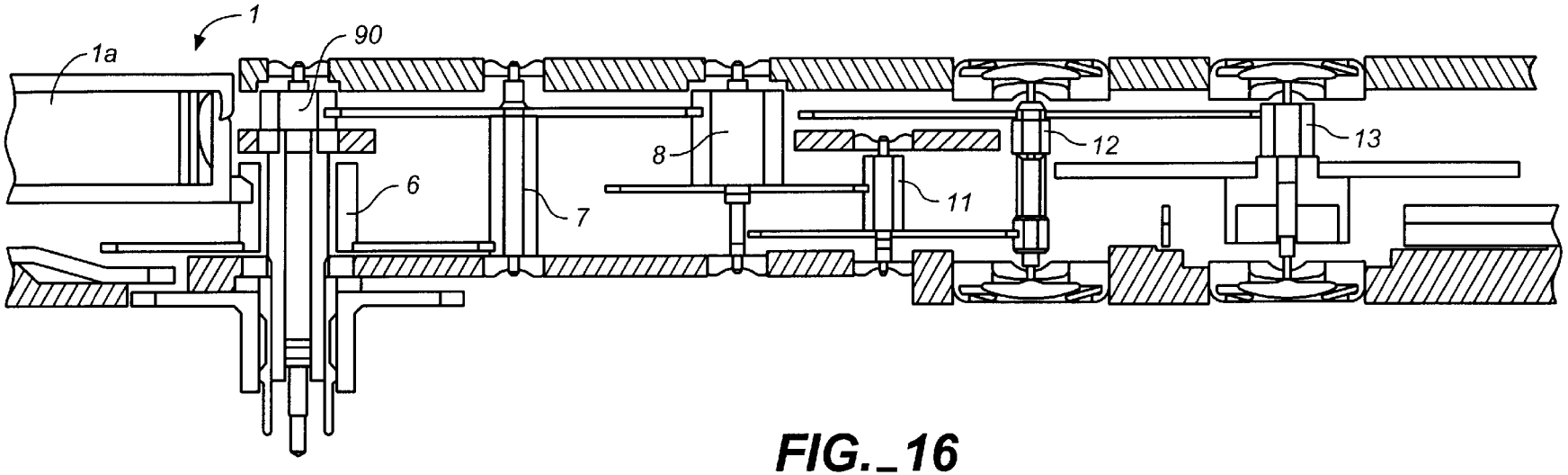
FIG. 16 is a sectional view showing the conventional timepiece.

FIG. 1 is a plan view schematically showing an electronic controlling type mechanical timepiece used as the timepiece of the first embodiment, and FIGS. 2 to 4 are sectional views of the main portion thereof. Component parts corresponding to those illustrated in FIG. 16 are given the same reference numerals.

Referring to FIGS. 1 to 4, the electronic controlling type timepiece includes a movement barrel 1 comprising a mainspring 1*a*, a barrel gear 1*b*, a barrel arbor 1*c*, and a barrel cover 1*d*. The outer end of the mainspring 1*a* is secured to the barrel gear 1*b*, while the inner end thereof is secured to the barrel arbor 1*c*. The barrel arbor 1*c* which is cylindrical in shape is inserted into a supporting member 2 in order to be supported in a cantilever fashion to a main plate 3 by the supporting member 2. The barrel arbor 1*c* is held down by a square-hole screw 5 screwed into the supporting member 2 so that it does not get dislodged towards the top side in the figures, with a play being formed in a sectional direction. The supporting member 2 has a flange 2*a* at the main plate 3 side thereof. A peripheral edge of the flange 2*a* at the lower side in the figures is caulked to secure the supporting member 2 to the main plate 3, so that the supporting member 2 rarely falls over. The supporting member 2 may be secured to the main plate 3 by a method other than caulking, such as welding or brazing. The supporting member 2 and the main plate 3 do not have to be formed separately. For example, when the main plate 3 is formed of a metal, the supporting member 2 may be previously integrally formed with the main plate 3 by cutting a plate used when producing the main plate 3 and leaving a portion thereof to form a shape corresponding to that of the supporting member 2, after which the shaped portion is previously integrally formed with the main plate 3. When, the main plate 3 is formed of resin, the supporting member 2 may be previously integrally formed with the main plate 3 by designing a mold in a suitable way and, using this mold, making a shape which corresponds to that of the supporting member 2 protrude from the main plate 3.

A ratchet wheel 4 which rotates integrally with the barrel arbor 1*c* is disposed between the movement barrel 1 and the main plate 3. A center hole in the ratchet wheel 4 has a square shape or the shape of a track. With the center hole being inserted onto the square portion (chamfered portion) of the barrel arbor 1*c*, the ratchet wheel 4 is clamped by a stopper section 1*e* of the barrel arbor 1*c* and the main plate 3, so that it is disposed in a "thrown-in" structure.

The rotational motion of the barrel gear 1*b* which has been transmitted to a pinion 6*a* of a second wheel 6 is, from a gear 6*b* of the second wheel 6, increased in speed and transmitted to a pinion 7*a* of a third wheel 7. Then, from a gear 7*b* of the third wheel 7, the rotational motion is increased in speed and transmitted to a pinion 8*a* of a fourth wheel 8. From a gear 8*b* of the fourth wheel 8, the rotational motion is, through a fifth-wheel first intermediate wheel 9, increased in speed and transmitted to a pinion 10*a* of a fifth-wheel second intermediate wheel 10. From a gear lob of the fifth-wheel second intermediate wheel 10, the rotational motion is increased in speed and transmitted to a pinion 11*a* of a fifth wheel 11. From a gear 11*b* of the fifth wheel 11, the rotational speed is increased in speed and transmitted to a pinion 12*a* of a sixth wheel 12. From a gear 12*b* of the sixth wheel 12, the rotational speed is increased in speed and transmitted to a rotor 13. The second wheel 6 includes a cannon pinion 6*c*. A minute hand which is not shown is secured to the cannon pinion 6*c*, while a second hand which is not shown is secured to the fourth wheel 8. In other words, in the embodiment, the second wheel 6, to which the minute hand is secured through the cannon pinion 6*c*, and the fourth wheel 8, to which the second hand is secured, are incorporated in series in a path for transmitting torque from the movement barrel 1 to the rotor 13, so that when the hands are moving, the wheels receive torque in the direction of rotation thereof from the barrel drum at all times, so that backlash is formed towards one side. Therefore, the shaking of the minute hand and the second hand due to backlash between the second wheel 6 and the fourth wheel 8 is prevented from occurring.

The top sides of the second wheel 6 and the fifth wheel 11 are axially supported by a second wheel bridge 15, while the bottom sides thereof are axially supported by the main plate 3. The top sides of the third wheel 7, the fifth-wheel second intermediate wheel 10, the sixth wheel 12, and the rotor 13 are axially supported by a wheel train bridge 14, while the bottom sides thereof are axially supported by the main plate 3. The top sides of the fourth wheel 8 and the fifth-wheel first intermediate wheel 9 are axially supported by the wheel train bridge 14, while the bottom sides thereof are axially supported by the second wheel bridge 15. The fifth-wheel first intermediate wheel 9 is not particularly a wheel which includes a pinion and a gear, but rather a wheel which includes only a gear, so that it is an idler (that is, an idle wheel). The axis of rotation of the fifth-wheel first intermediate wheel 9 overlaps the gear 6*b* of the second wheel 6 and the gear 10*b* of the fifth-wheel second intermediate wheel 10 when viewed in a plane. The axis of rotation of the fifth wheel 11 overlaps the sixth wheel 12 when viewed in a plane. In the fourth wheel 8 to which the second hand is attached, the pitch circle diameter of the gear 8*b* is at least 1.5 mm, so that it has a size which does not allow it to overlap the mainspring 1*a* (or the movement barrel 1) when viewed in a plane. The wheel train comprising each of the above-described wheels 6 to 12 are disposed so that they do not overlap coils 24 and 34 of a generator 20 described later.

In contrast, the barrel gear 1*b* and the gear 8*b* of the fourth wheel 8 overlap each other when viewed in a plane, and, by making the outside diameter of the barrel gear 1*b* large, the speed-increase ratio between it and the pinion 6*a* of the second wheel 6 is made larger.

The electronic controlling type mechanical timepiece includes the generator comprising the rotor 13 and coil blocks 21 and 31.

The rotor 13 comprises a rotor pinion 13*a* which meshes the sixth wheel 12, a rotor magnet 13*b*, and a nonmagnetic inertial disk 13*c* serving as an inertial plate.

The coil block 21 comprises a coil 24 wound upon a core (or a magnetic core) 23, while the coil block 31 comprises a coil 34 wound upon a core (or a magnetic core) 33. The cores 23 and 33 comprise respective core stators 22 and 32 disposed adjacent the rotor 13, respective core magnetism conducting sections 23*a* and 33*a* connected together, and respective core winding sections 23*b* and 33*b* upon which the respective coils 24 and 34 are wound, with these component parts being formed integrally. The core stators 22 and 32 form a stator hole 20*a* for accommodating the magnet 13*b* of the rotor 13 therein. A bush 60 serving as a member for supporting the rotor 13 is provided in the stator hole 20*a*, and a section 61 with the shape of a stator guide is provided at the bush 60 in correspondence with the locations of portions of the coil blocks 21 and 31 where the stator hole 20*a* is formed.

When the rotor 13 is disposed in the stator hole 20*a*, the rotor inertial disk 13*c* of the rotor 13 is disposed between the core stators 22 and 32 and the sixth wheel 12, above the core stators 22 and 32 in FIG. 4, that is, in a wide gap between the core stators 22 and 32 and the wheel train bridge 14. Here, a gap G1 extending axially between the rotor magnet 13*b* of the rotor 13 and the sixth wheel 12 is made sufficiently large such that it is at least 0.5 times a gap G2 extending in a direction of a plane of the rotor magnet 13*b* and the core stators 22 and 32 (that is, G1 is equal to or greater than 0.5×G2). Thus, magnetic flux leakage does not often occur from the rotor magnet 13*b* to the sixth wheel 12. The gear 12*b* of the sixth wheel 12 is formed of a nonmagnetic material such as brass. It is preferable that nonmagnetic members, such as the rotor inertial disk 13*c*, disposed near the rotor magnet 13*b* be separated at a sufficiently large distance which is at least 0.5 times the gap G2 extending in the direction of the plane of the rotor magnet 13*b* and the core stators 22 and 32.

The cores 23 and 33, that is, the coils 24 and 34 are disposed parallel to each other. The rotor 13 is constructed so that, at the core stator sides 22 and 32, the center axis thereof is disposed on a boundary line L between the coils 24 and 34, with the core stators 22 and 32 being symmetrically disposed on the left and right sides of the boundary line L. The number of windings of the coils 24 and 34 are the same. Since the number of windings is usually a few tens of thousands of turns, the numbers of windings do not have to be exactly the same. There may be a difference in the number of windings as long as this difference is negligible compared to the total number of windings. For example, there may be a difference of the order of a few hundred turns. The core magnetism conducting section 23*a* of the core 23 and the core magnetism conducting section 33*a* of the core 33 are connected together, so that the cores 23 and 33 form an annular magnetic circuit. The coils 24 and 34 are wound towards the same direction with respect to a direction from the core magnetism conducting sections 23*a* and 33*a* of the respective cores 23 and 33 to the respective core stators 22 and 32.

Figure 5:
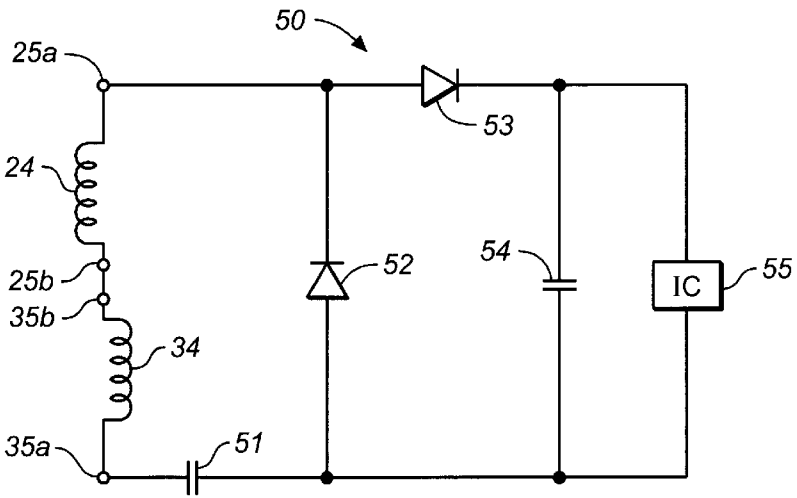
FIG. 5 is a circuit diagram of the first embodiment.

Ends of the coils 24 and 34 are connected to a coil lead substrate provided on the core magnetism conducting sections 23*a* and 33*a* of the respective cores 23 and 33. Accordingly, as shown in the circuit diagram of FIG. 5, as regards coil terminals 25*a* and 25*b* and coil terminals 35*a* and 35*b* on the lead substrate, the coil terminals 25*b* and 35*b* are connected together in order to connect the coils 24 and 34 in series, and the coil terminals 25*a* and 35*a* are connected to a pressure-increasing rectifying circuit 50 comprising a pressure-increasing capacitor 51 and diodes 52 and 53. Thus, alternating current outputs from the coils 24 and 34 are increased in pressure and rectified by the pressure-increasing rectifying circuit 50 in order to charge a smoothing capacitor 54. From the capacitor 54, the resulting alternating currents are supplied to an IC 55 in order to, for example, perform a speed-regulating operation when the hands are moving. Since the directions of winding of the coils 24 and 34 with respect to a direction in which magnetic flux flows in the respective cores 23 and 33 are the same as a result of connecting the terminals 25*b* and 35*b* of the respective coils 24 and 34, the alternating current outputs obtained after the electromotive voltages in the coils 24 and 34 have been added are supplied to the pressure-increasing rectifying circuit 50. In the embodiment, the speed-regulating device used in the present invention comprises the above-described generator 20, the pressure-increasing rectifying circuit 50, and the IC 55.

In the case where the electronic controlling type mechanical timepiece having the above-described structure is used, when an external magnetic field H (see FIG. 1) is applied to each of the coils 24 and 34, the external magnetic field H is applied in the same direction to each of the coils 24 and 34 disposed parallel to each other, so that, with respect to the directions of winding of the coils 24 and 34, the external magnetic fields H are applied in opposite directions. Therefore, the electromotive voltage generated in the coil 24 and that generated in the coil 34 by the external magnetic field H cancel each other, making it possible to reduce the effects resulting therefrom.

In the above-described electronic controlling type mechanical timepiece, by operating a winding stem 40 (see FIG. 1) connected to a crown which is not shown, the mainspring 1*a* is wound as a result of rotating the ratchet wheel 4 through a winding pinion 41, a crown wheel 42, a first intermediate ratchet wheel 43, and a second intermediate ratchet wheel 44. Here, the direction of rotation of the ratchet wheel 4 is regulated by a click 4*a*. Similarly, by operating the winding stem 40, the minute hand and the hour hand are adjusted through a sliding pinion 45, a setting wheel which is not shown, a minute intermediate wheel, and a minute wheel 46 (see FIG. 2), during which case, a driving system is such as to stop a train wheel setting lever by, for example, bringing it into contact with the fifth wheel 11. Instead of using a manual winding mechanism, the mainspring 1*a* may also be wound using an automatic winding mechanism in which the mainspring 1*a* is wound up, by for example, rotating a rotating weight. Since the mechanism used to adjust the minute hand and the hour hand to the correct time is the same as that used in known mechanical timepieces, it will not be described in detail below.

The embodiment provides the following advantages:

1) Since the fourth wheel 8 to which the second hand is attached includes the pinion 8*a* and the gear 8*b*, when the third wheel 7 and the pinion 8*a* of the fourth wheel 8 are brought into engagement, and the gear 8*b* is brought into engagement with the fifth-wheel first intermediate wheel 9, the diametrical dimension from the center of rotation of the fourth wheel 8 to a portion where it engages the fifth-wheel first intermediate wheel 9 can be made large, without changing the speed-increase ratio from the second wheel 6 to the fourth wheel 8. Therefore, even if the fourth wheel 8 is decentered, the effect of the decentering at the center-of-rotation side is small, making it possible to reduce the shifting of the second hand.

Figure 6:
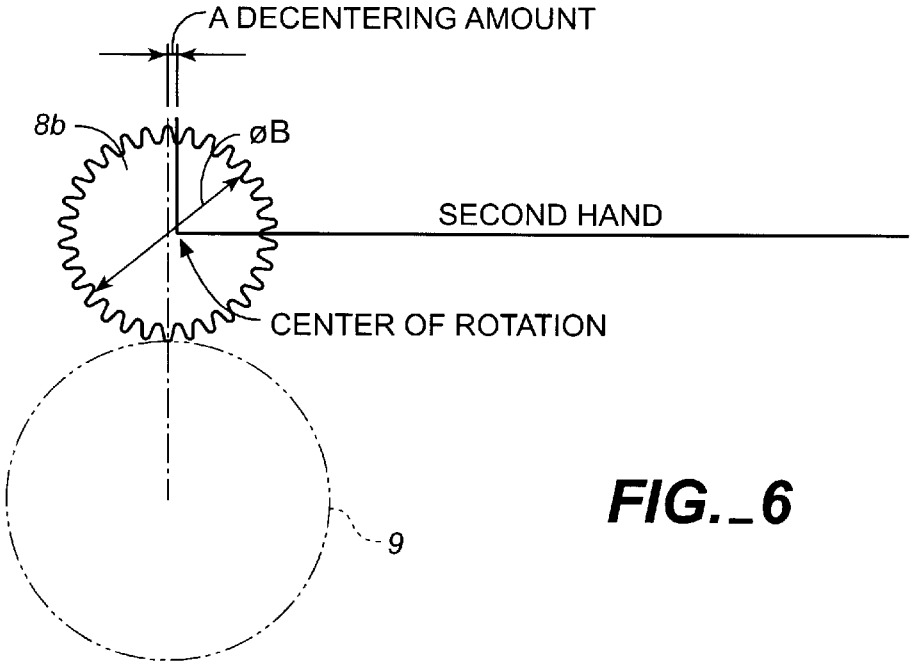
FIG. 6 is a plan view illustrating the advantages of the first embodiment.
Figure 7:
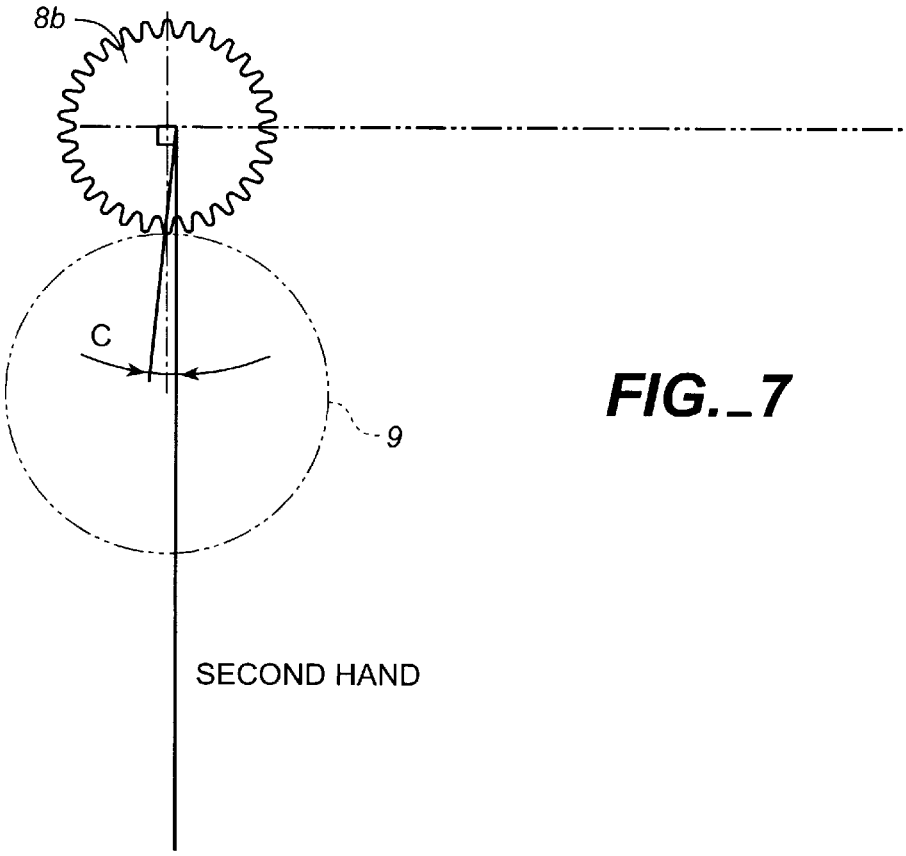
FIG. 7 is another plan view illustrating the advantages of the first embodiment.

If the rotor 13 is rotating at a constant speed of 8 Hz as a result of regulating its speed, and the fifth-wheel first intermediate wheel 9 which engages the fourth wheel gear 8*b* is rotating at a constant speed, in the case where the fourth wheel gear 8*b* with 30 teeth rotates at an angle of 90° (corresponding to 15 seconds) with no decentering, the fourth wheel gear 8*b* advances by an amount corresponding to 30 teeth×90°/360°=7.5 teeth. As shown in FIG. 6, if the center of rotation of the fourth wheel gear 8*b* (with a pitch circle diameter of $\phi$B) is decentered by a decentering amount A, the fourth wheel gear 8*b* can only advance, as shown in FIG. 7, by an amount corresponding to 90°−C, so that the second hand is shifted by a shift amount C ($=\tan^{-1}(2A/B)$). Here, the decentering amount A determines the processing capability, so that, in order to make the shift amount C as small as possible, the pitch circuit diameter $\phi$B of the fourth wheel gear 8*b* is made large to facilitate the processing, whereby the aforementioned advantage is obtained. Although the second hand gets shifted as a result of the decentering of the fourth wheel gear 8*b* or any of the wheels from the fifth-wheel first intermediate wheel 9 to the rotor 13 or as a result of variations in the shapes of the teeth of the wheels, the decentering or variations in the shapes of the teeth of wheels closer to the fourth wheel to which the second hand is mounted affect the shifting of the second hand to a greater extent, so that the shifting can be made less more effectively by making the outside diameter of the fourth wheel gear 8*b* large.

Since the teeth-shaped module of the fourth wheel 8 (or the pinion 8*a*) and the third wheel 7 are not made considerably large, or since the speed-increase ratio between the second wheel 6 and the third pinion is not made large, there is no need to worry about the engaging efficiency being reduced.

2) Since the fourth wheel 8 to which the second hand is mounted is disposed so as not to overlap the mainspring 1*a*, the width of the mainspring 1*a* can be made correspondingly larger, so that the timepiece can be made to continue operating for a longer period of time as a result of increasing the torque of the mainspring 1*a*, without changing the thickness of the entire timepiece.

3) Since the fourth wheel gear 8*b* and the barrel gear 1*b* overlap when viewed in a plane, and the outside diameter of the barrel gear 1*b* is large, the speed-increase ratio between it and the second wheel 6 which engages therewith can be made large, and the winding down of the mainspring 1*a* when the wheel train is rotating at a constant speed can be slowed down, so that the timepiece can continue operating for a longer period of time.

4) The wheel train comprising each of the wheels 6 to 12 is disposed so as not to overlap the coils 24 and 34, so that the number of windings can be increased based on corresponding increases in the diametrical dimensions of the coils 24 and 34, so that the axial lengths of the coils 24 and 34, and, hence, the magnetic path lengths become shorter. Consequently, iron loss such as hysteresis loss or eddy current loss occurring when magnetic fields are generated in the coils 24 and 34 are reduced, making it possible to operate the timepiece with a smaller amount of mainspring energy, so that, here again, the timepiece can continue operating for a longer period of time.

5) Since the inertial disk 13*c* of the rotor 13 is disposed in a wide gap between the core stators 22 and 32 and the wheel train bridge 14, the effects of air viscosity resistance of the air in this gap on the inertial disk 13*c* can be reduced, making it possible to reduce the load torque necessary to rotate the rotor 13. Therefore, the timepiece can be operated with a smaller amount of mainspring energy, so that, here again, the timepiece can continue operating for a longer period of time.

6) Since the gap G1 extending in the axial direction between the magnet 13*b* of the rotor 13 and the sixth wheel 12 is sufficiently large so as to be at least 0.5 times the gap G2 in the direction of the plane of the rotor magnet 13*b* and the core stators 22 and 32, the magnetic flux leakage from the rotor magnet 13*b* to the sixth wheel 12 can be decreased, making it possible to restrict eddy current loss at the sixth wheel 12. Thus, the load torque required to rotate the rotor 13 can be reduced, so that the timepiece can be operated with a smaller amount of mainspring energy, whereby, here again, the timepiece can continue operating for a longer period of time.

7) The pitch circle diameter of the gear 8*b* of the fourth wheel 8 to which the second hand is mounted is at least 1.5 mm, so that the effects resulting from decentering can be made sufficiently small, whereby the shifting of the hand can be effectively and reliably prevented.

Since the fourth wheel 8 is disposed in series in the torque transmission path from the movement barrel 1 to the rotor 13, the fourth wheel 8 can at all times be disposed such that backlash is formed towards one side, making it possible to prevent the shaking of the second hand without providing a second regulating spring or the like.

8) Since the movement barrel 1 is supported by the main plate 3 alone, and the wheel train bridge 14 is formed away from the movement barrel 1 to prevent interference of the wheel train bridge 14 with the movement barrel 1, the width of the mainspring 1*a* can be made correspondingly larger, so that the timepiece can continue operating for a longer period of time. Instead of increasing the width of the mainspring 1*a*, the wheel train bridge 14 can be disposed closer to the main plate 3, in which case the timepiece can be made thinner.

9) Since one end of the fifth-wheel first intermediate wheel 9 engaging the fourth wheel 8 is axially supported by the wheel train bridge 14, while the other end thereof is axially supported by the second wheel bridge 15, the axis of rotation of the fifth-wheel first intermediate wheel 9 can be positioned so as to overlap the gears 7*b* and 10*b* of the respective second wheel 6 and the fifth-wheel second intermediate wheel 10 when viewed in a plane. Therefore, it is not necessary to make the gear 8*b* of the fourth wheel 8 larger than necessary in order to allow it to engage the fifth-wheel second intermediate 10 through the fifth-wheel first intermediate wheel 9, and, in turn, to the fifth wheel 11, making it possible to reliably transmit the torque of the mainspring 1*a* to the rotor 13. The axis of rotation of the fifth-wheel first intermediate wheel 9 can overlap the gears 6*b*, 7*b*, and 10*b* of the respective second wheel 6, third wheel 7, and fifth-wheel second intermediate wheel 10, so that the timepiece can be formed with a smaller diameter.

10) Since the fifth-wheel first intermediate wheel 9 is an idle wheel, compared to the case where the fifth-wheel first intermediate wheel includes a pinion and a gear, it can be made thinner, making it possible to promote the production of thinner timepieces.

11) One end of the fifth wheel 11 is axially supported by the second wheel bridge 15, and the other end thereof is axially supported by the main plate 3, making it possible for the axis of rotation of the fifth wheel 11 to overlap the sixth wheel 12, so that the gear 12*b* of the sixth wheel 12 can be made large without interfering with the fifth wheel 11. Therefore, the speed-increase ratio between the sixth wheel 12 and the rotor 13 can be made large, making it possible to rotate the rotor 13 which engages the gear 12*b* at a high speed, and, thus, to increase the efficiency with which electrical power is generated. By making the axis of rotation of the fifth wheel 11 overlap the sixth wheel 12, the wheel train can be disposed in a smaller space without the axis of rotation of the fifth wheel being interfered with, making it possible to reduce the diameter of the timepiece.

12) When the gear 12*b* of the sixth wheel 12 is made large, the diameter of the inertial disk 13*c* of the rotor 13 can be made large. Thus, sufficient inertia can be obtained without increasing the weight of the rotor 13, whereby the rotor 13 can be stably rotated. In addition, it is possible to prevent the problem of breakage or bending of the tenon of the rotor 13 occurring when, for example, the timepiece is dropped.

13) Since the rotor inertial disk 13*c* is disposed between the sixth wheel 12 and the core stators 22 and 32, the gap G1 between the sixth wheel 12 and the core stators 22 and 32 can be made sufficiently large, so that eddy current loss at the sixth wheel 12 can be reduced in order to, here again, allow the timepiece to continue operating for a longer period of time. Since the gap G1 can be effectively used to dispose the rotor inertial disk 13*c*, even if the rotor inertial disk 13*c* is disposed, it is possible to prevent the timepiece from becoming considerably thick.

14) Since the section 61 having the shape of a stator guide is formed at the bush supporting one end of the rotor 13 in correspondence with the portions of the coil blocks 21 and 31 where the stator hole 20*a* is formed, when each of the coil blocks 21 and 31 is secured to the main plate 3, the core stators 22 and 32 can be guided by the section 61, making it possible to increase the precision with which the core stators 22 and 32 are positioned.

15) In the generator 20, the cores 23 and 33 having identical shapes are disposed symmetrically on the left and right sides, and the coils 24 and 34 having the same number of windings are connected in series. Therefore, the same number of magnetic flux lines of the external magnetic field H flows into the two coils 24 and 34, making possible to cancel the electromotive voltages produced thereby, so that an electronic controlling type mechanical timepiece which is highly resistant to magnetic noise can be formed.

16) Since the magnetic noise caused by the external magnetic field H can be reduced, it is no longer necessary to provide a magnetism-resistant plate on movement parts such as a character plate of the timepiece, or a magnetism-resistant material on exterior parts. Therefore, costs can be reduced. In addition, since a magnetism-resistant plate is not needed, the timepiece can correspondingly and reliably be made smaller and thinner, which in turn allows the timepiece to be designed more freely because the placement of each of the parts is not restricted by exterior component parts, so that an electronic controlling type mechanical timepiece which, for example, is elaborately designed and provides high manufacturing efficiency can be provided.

17) Since the effects of magnetic noise is small, the output waveform is substantially a sine wave, so that the output waveform can be easily detected by, for example, dividing it using a suitable threshold value and performing a binary operation, thereby making it possible for, for example, the number of rotations of the rotor 13 to be easily detected. Consequently, it is possible to precisely and easily control the timepiece which makes use of the output waveform of the generator.

[Second Embodiment]

Figure 8:
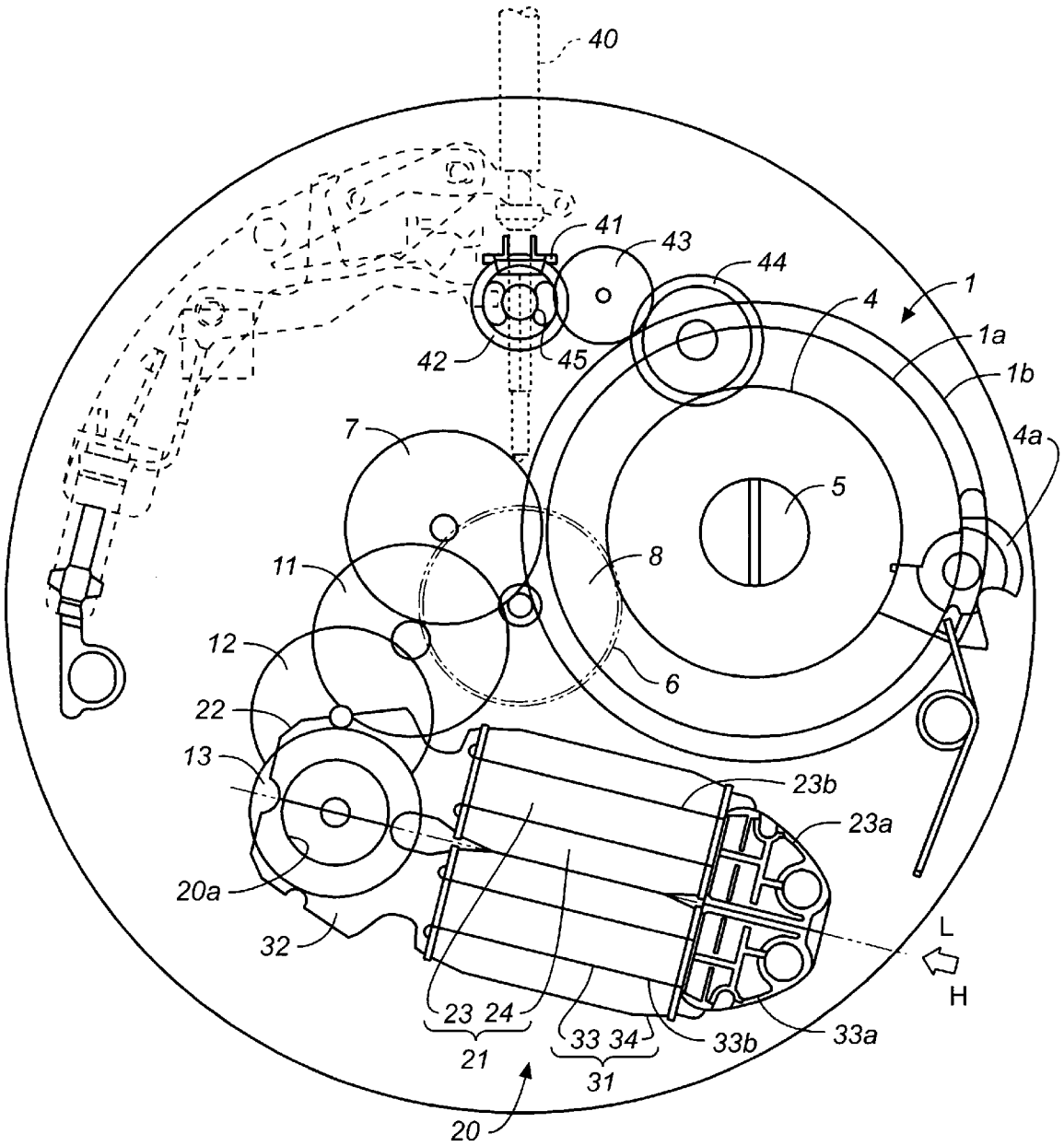
FIG. 8 is a plan view schematically showing a second embodiment of the electronic controlling type mechanical timepiece in accordance with the present invention.
Figure 9:
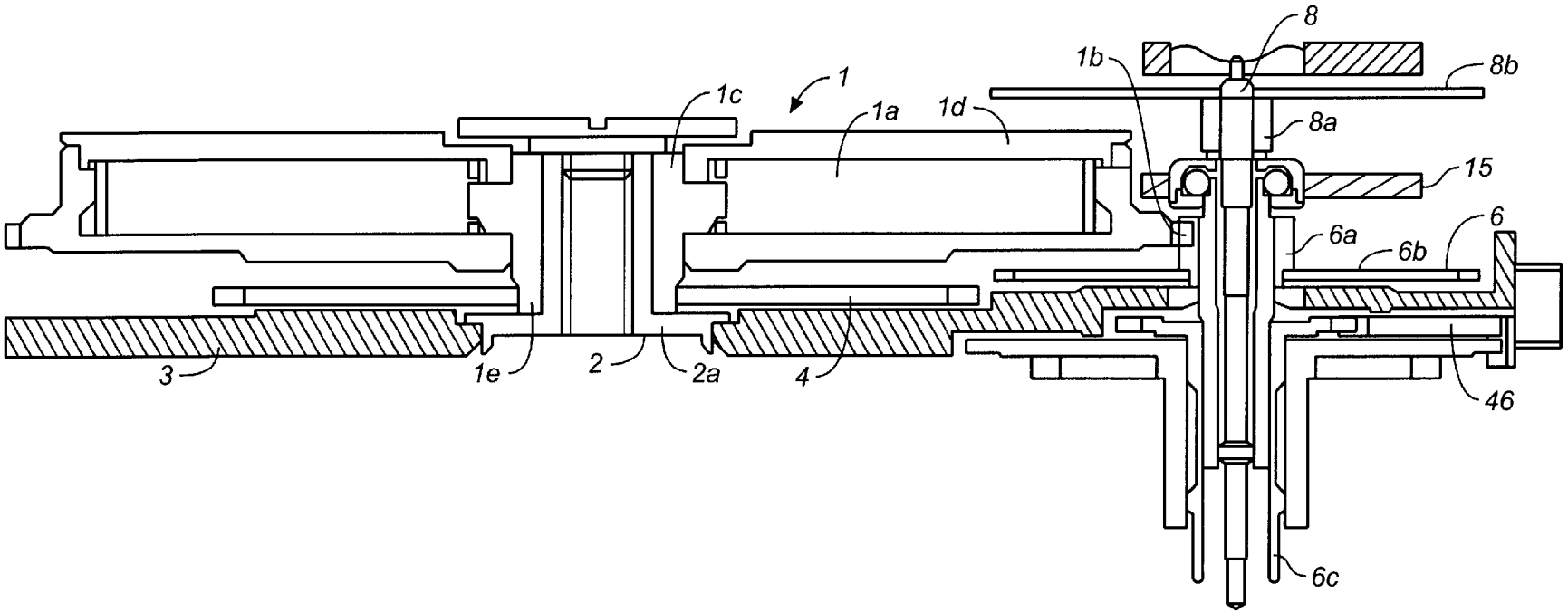
FIG. 9 is a sectional view of the main portion of the second embodiment.
Figure 10:
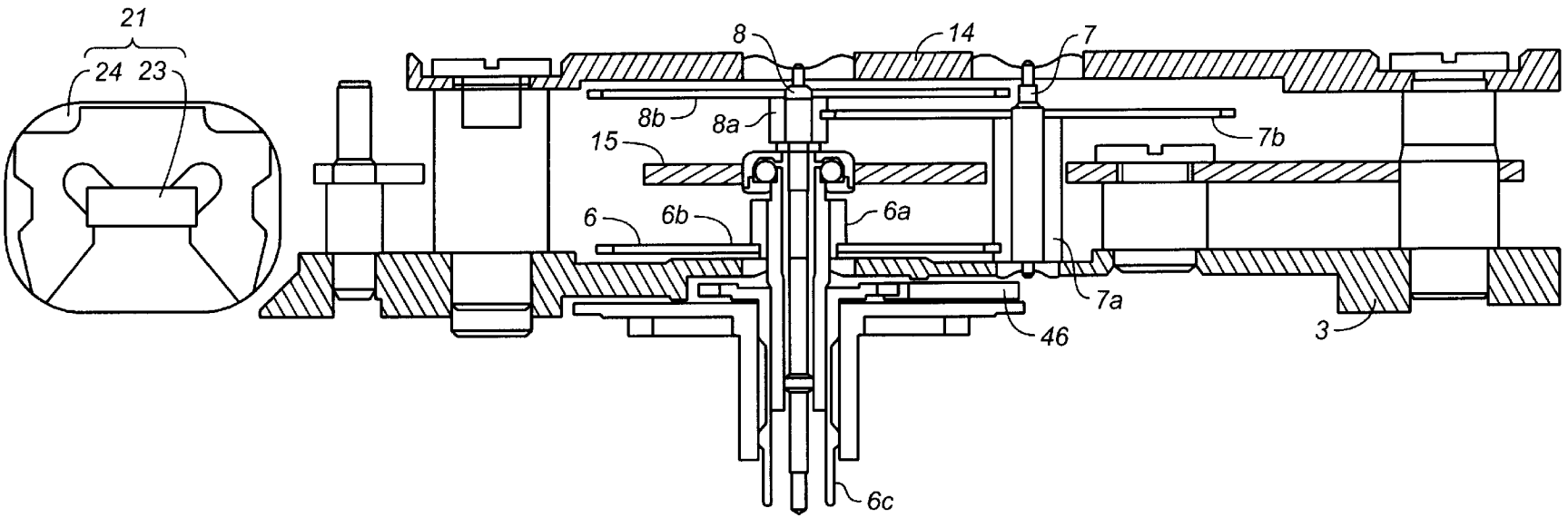
FIG. 10 is another sectional view of the main portion of the second embodiment.
Figure 11:
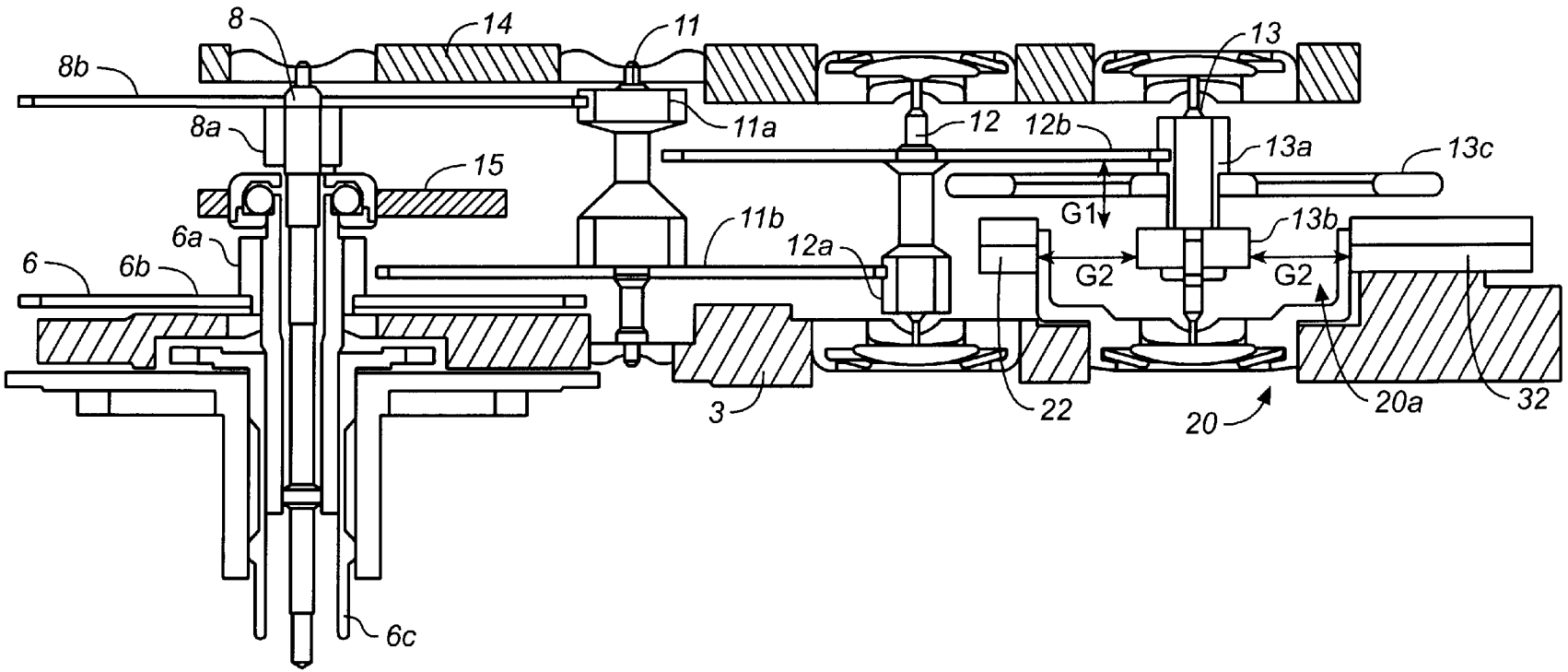
FIG. 11 is still another sectional view of the main portion of the second embodiment.

FIG. 8 is a plan view schematically showing a second embodiment of the electronic controlling type mechanical timepiece in accordance with the present invention. FIGS. 9 to 11 are sectional views of the main portion thereof In the embodiment, structural parts similar to those of the first embodiment are given the same reference numerals. Descriptions thereof will either be simplified or omitted.

In the embodiment, the pitch circle diameter of a gear 8*b* of a fourth wheel 8 is smaller than that in the first embodiment, and the gear 8*b* directly engages a pinion I1*a* of a fifth wheel 11. Therefore, since the gear 8*b* is large, a fifth-wheel first intermediate wheel 9 and a fifth-wheel second intermediate wheel 10 (shown in FIGS. 1 and 4) are not used, and the gear 8*b* overlaps the mainspring 1*a* when viewed in a plane. The fifth wheel 11 is axially supported by a main plate 3 and a wheel train bridge 14, so that the pitch circle diameter of a gear 12*b* of a sixth wheel 12 is smaller than that in the first embodiment. The other structural features are substantially the same as those of the first embodiment.

In this embodiment, the fifth-wheel first and second intermediate wheels 9 and 10 (see FIGS. 1 and 4) are not used, the gear 8*b* of the fourth wheel 8 overlaps the mainspring 1*a*, and the fifth wheel 11 is axially supported by the main plate 3 and the wheel train bridge 14. Therefore, the aforementioned advantages 2), 7), 9), 10), 11), and 12) cannot be obtained. However, since it has structural features similar to those of the first embodiment, the other advantages can be obtained. The above-described distinctive structural features of the embodiment make it possible to provide the following advantages.

18) Since the pitch circle of the gear 8*b* of the fourth wheel 8 is large, it is possible to more satisfactorily prevent, in particular, the shifting of the second hand caused by the decentering of the fourth wheel 8.

19) Since the fifth-wheel first and second intermediate wheels 9 and 10 (see FIGS. 1 and 4) are not used, the number of component parts used can be correspondingly decreased, making it possible to reduce the cost of the parts used and parts assembly costs, so that the cost of the timepiece can be reduced.

[Embodiments]

Figure 12:
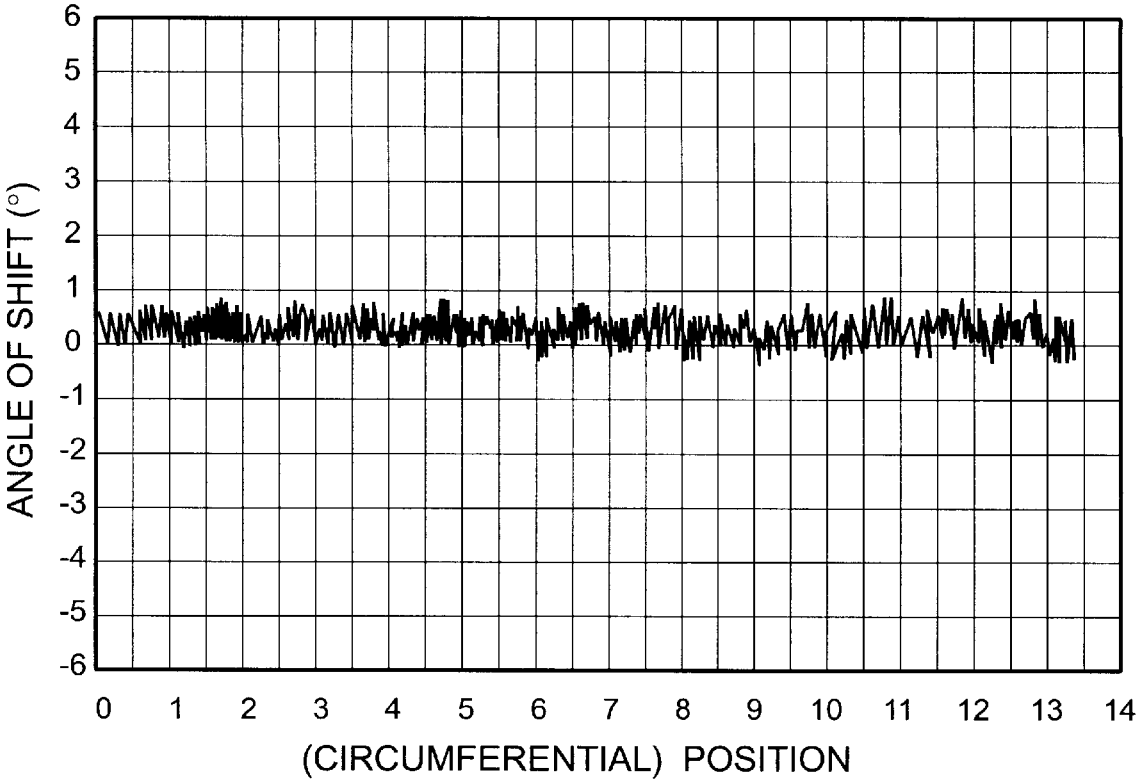
FIG. 12 is a graph showing the results in one embodiment.
Figure 15:
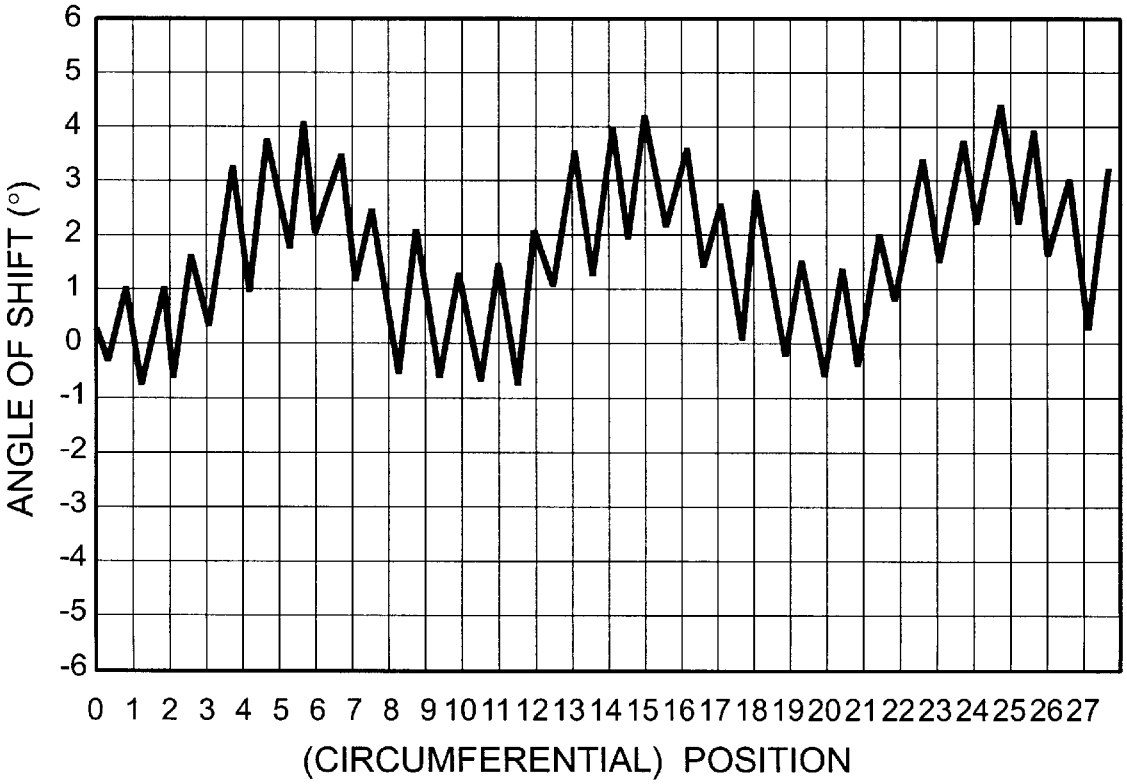
FIG. 15 is a graph illustrating a conventional timepiece.

FIG. 12 shows the measurement results of the shift angles of the second hand in the first embodiment of the electronic controlling type mechanical timepiece. In the embodiment, the pitch circle diameter of the gear 8*b* of the fourth wheel 8 is 1.5 mm.

As is clear from FIG. 12, the shift angle lies within a range of from −0.4° to +1°, so that the shift in position is greatly reduced.

The length of time the timepiece continued operating was measured from the start of the movement of the hand resulting from maximally winding up the mainspring 1*a* to the termination of the movement of the hand. The results confirmed that the electronic controlling type mechanical timepiece continued operating for a longer period of time than a conventional electronic controlling type mechanical timepiece. The thickness of the timepiece of the first embodiment is substantially the same as the thickness of the conventional electronic controlling type mechanical timepiece.

Therefore, it has been found that the present invention is effective in achieving the above-described object.

The invention thus described is intended to embrace all such alternatives, modifications and variations as may fall within the spirit and scope of the appended claims. For example, the present invention is not limited to the above-described embodiments, so that other structures may also used to achieve the above-described object. The following modifications may be made.

Figure 13:
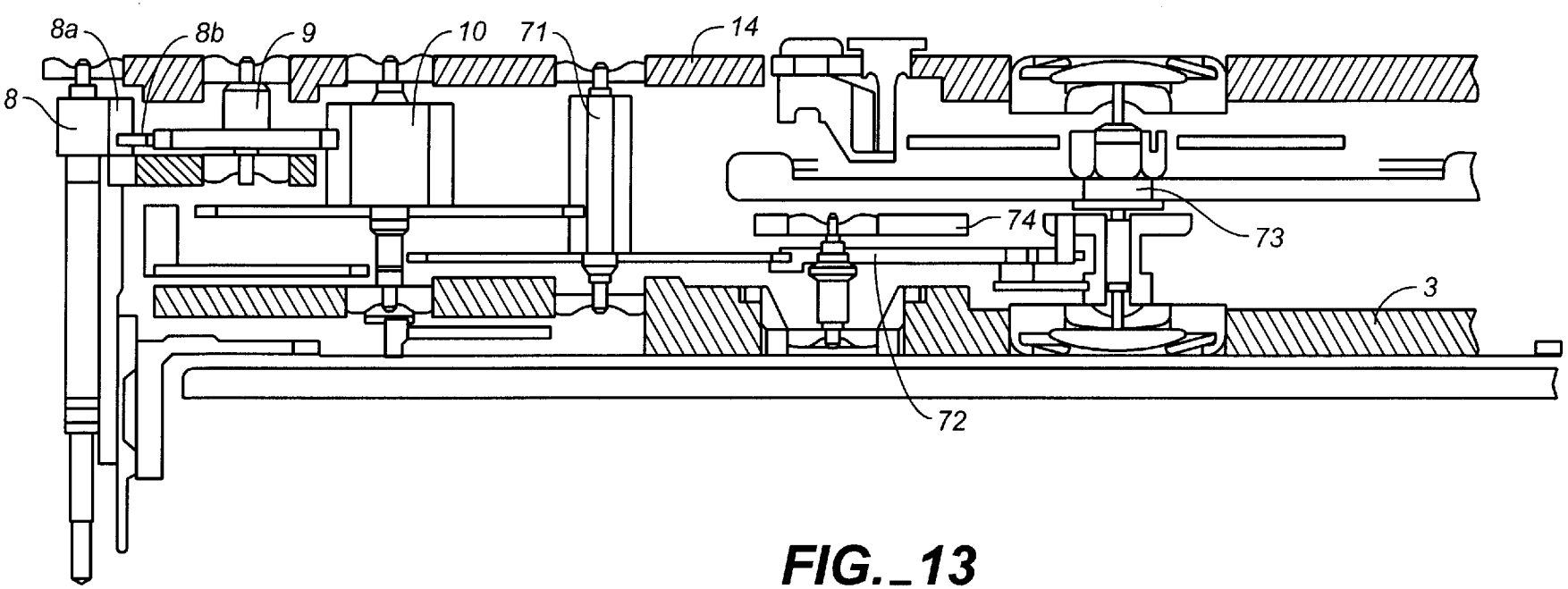
FIG. 13 is a sectional view of a modification of the present invention.

Therefore, in addition to the first-embodiment electronic controlling type mechanical timepiece, the invention of claim 1 includes a mechanical timepiece illustrated in FIG. 13.

In this mechanical timepiece, a fifth-wheel second intermediate wheel 10 engages an escape wheel 71, and power is transmitted from a mainspring (not shown) to a mechanical escapement serving as a speed-regulating device comprising the escape wheel 71, a pallet fork 72, and a timed annular balance 73, with a time standard being created by the escapement. Since this structure, principles, etc. are conventionally known, a detailed description will not be made. In the figure, reference numeral 74 denotes a pallet bridge. The other structural features are similar to those of the first embodiment, in which, for example, a fourth wheel 8 to which a second hand is attached includes a pinion 8*a* and a gear 8*b*, and the fourth wheel 8 is disposed so as not to overlap the mainspring.

In this structure, although the speed of the wheel train may not be as precisely regulated as that of the first-embodiment electronic controlling type mechanical timepiece, the aforementioned advantages 1), 2), 9), and 10) can be obtained because it has structural features similar to those of the first embodiment. In addition, although not illustrated in FIG. 13, the aforementioned advantage 3) may similarly be obtained by overlapping the fourth wheel 8 and the barrel gear when viewed in a plane.

Although the generator 20 used in each of the above-described embodiments includes symmetrically formed left and right cores 23 and 33, with the rotor 13 being disposed midway between them, the cores may, for example, be asymmetrically formed, so that the present invention includes the case where the rotor 13 is disposed towards one of the cores. However, it is preferable to use the cores 23 and 33 used in the embodiments because resistance to magnetism can be increased by making the number of turns of the coils 24 and 34 equal to each other.

Figure 14:
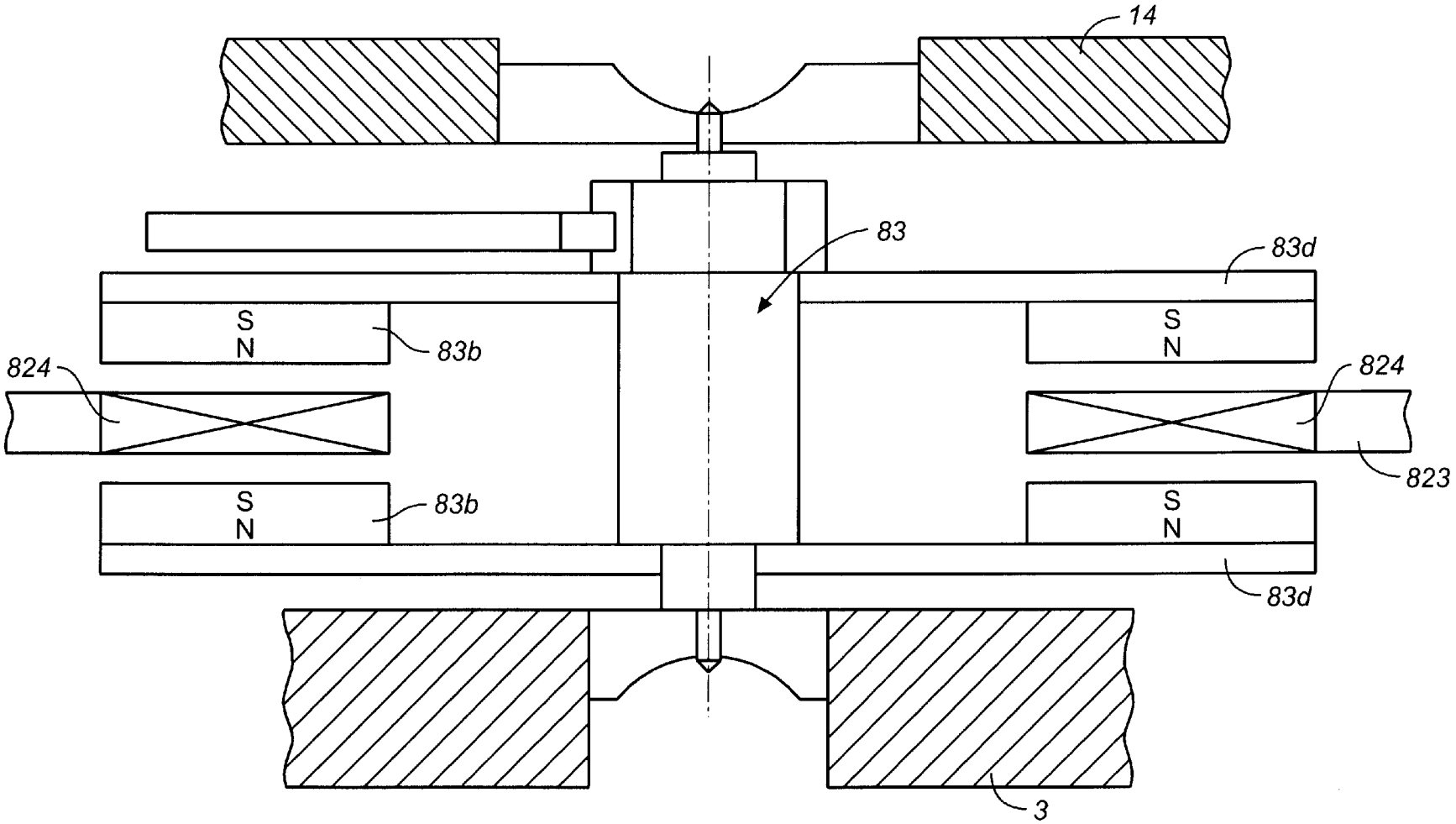
FIG. 14 is a sectional view of another modification of the present invention.

Although, in the generator 20 used in each of the embodiments, the rotor 13 includes the inertial disk 13*c*, a rotor 83 shown in FIG. 14 which is a type of rotor which does not include an inertial disk may also be used in the generator used in the present invention. The rotor 83 has a structure which is similar to that of a brushless motor. More specifically, the rotor 83 includes a pair of disk-shaped magnets 83*b* which are axially separated apart, with each rotor magnet 83*b* being supported by a flat back yoke 83*d*. A substrate 823 is disposed between the rotor magnets 83*b*, while a plurality of coils 824 are provided at locations of the substrate 823 corresponding to the locations of the rotor magnets 83*b* in a peripheral direction thereof. The rotor 83 including the disk-shaped magnets 83*b*, itself, acts as an inertial plate, so that a rotor inertial disk 13*c* such as that used in the first embodiment is not provided.

Industrial Applicability

As can be understood from the foregoing description, according to the present invention, it is possible to reduce the amount by which the second hand is shifted, and, thus, to increase the length of time the timepiece continues operating without increasing the thickness of the entire timepiece.

What is claimed is:

1. A timepiece, comprising:

a mainspring;

a second hand;

a wheel train operably engaged with the mainspring and comprising a plurality of wheels including a second hand wheel to which the second hand is mounted, the second hand wheel including a pinion and a gear, each of which is rotatably mounted about the same axis of rotation and the gear being disposed so as not to overlap the mainspring; and a speed-regulating device that regulates a speed of rotation of the wheel train;

wherein the second hand is disposed so that torque developed by the mainspring is transmitted to the speed-regulating device.

2. A timepiece according to claim 1, further comprising a generator operably engaged with the wheel train, wherein the speed-regulating device includes an electronic circuit, driven by electric power generated by the generator, that regulates the speed of rotation of the wheel train by controlling a period of rotation of the generator.

3. A timepiece according to claim 1, further comprising a barrel drum having a barrel gear operably engaged with the mainspring, wherein the second hand wheel and the barrel gear are mounted so as to overlap each other.

4. A timepiece, comprising:

a mainspring;

a second hand;

a wheel train operably engaged with the mainspring and comprising a plurality of wheels including a second hand wheel to which the second hand is mounted, the second hand wheel including a pinion and a gear, each of which is rotatably mounted about the same axis of rotation;

a generator that is driven by the wheel train, the generator including a coil; and a speed-regulating device that controls a period of rotation of the generator to regulate a speed of rotation of the wheel train;

wherein the second hand is disposed so that torque developed by the mainspring is transmitted to the speed-regulating device; and wherein the wheel train is disposed so as not to overlap the coil of the generator.

5. A timepiece according to claim 1, wherein a pitch circle diameter of the second hand wheel is at least 1.5 mm.

6. A timepiece according to claim 4, wherein a pitch circle diameter of the second hand wheel is at least 1.5 mm.

7. A timepiece according to claim 3, further comprising a main plate, and wherein the barrel drum is supported in a cantilever fashion to the main plate.

8. A timepiece according to claim 4, further comprising a barrel drum having a barrel gear operably engaged with the mainspring, wherein the second hand wheel and the barrel gear are mounted so as to overlap each other.

9. A timepiece according to claim 1, further comprising:

a generator including a rotor driven by the wheel train, the plurality of wheels of the wheel train forming a torque transmission path between the mainspring and the generator;

a main plate;

a first wheel train bridge;

a second wheel train bridge disposed between the main plate and the first wheel train bridge; and an intermediate wheel operably engaged with, and disposed closer to the generator in the torque transmission system path than, the second hand wheel, the intermediate wheel being axially supported between the first and second wheel train bridges.

10. A timepiece according to claim 4, wherein the generator includes a rotor driven by the wheel train, the plurality of wheels of the wheel train forming a torque transmission path between the mainspring and the generator, the timepiece further comprising:

a main plate;

a first wheel train bridge;

a second wheel train bridge disposed between the main plate and the first wheel train bridge; and an intermediate wheel operably engaged with, and disposed closer to the generator in the torque transmission system path than, the second hand wheel, the intermediate wheel being axially supported between the first and second wheel train bridges.

11. A timepiece according to claim 9, wherein the intermediate wheel is an idle wheel.

12. A timepiece according to claim 10, where in the intermediate wheel is an idle wheel.

13. A timepiece according t o claim 9, wherein the plurality of wheels comprises a rotor wheel operably engaged with the rotor of the generator, and a second intermediate wheel located closer to the mainspring in the torque transmission path than the rotor wheel, the second intermediate wheel being axially supported between the second wheel train bridge and the main plate.

14. A timepiece according to claim 10, wherein the plurality of wheels comprises a rotor wheel operably engaged with the rotor of the generator, and a second intermediate wheel located closer to the mainspring in the torque transmission path than the rotor wheel, the second intermediate wheel being axially supported between the second wheel train bridge and the main plate.

15. A method of making a timepiece, comprising the steps of:

providing a mainspring;

providing a second hand;

providing a wheel train and disposing it so that it is operably engaged with the mainspring, the wheel train comprising a plurality of wheels including a second hand wheel to which the second hand is mounted, the second hand wheel including a pinion and a gear;

rotatably mounting the pinion and the gear about the same axis of rotation; and disposing the gear so as not to overlap the mainspring; and providing a speed-regulating device that regulates a speed of rotation of the wheel train;

wherein the second hand is disposed so that torque of the mainspring is transmitted to the speed-regulating device.

16. A method according to claim 15, further comprising the step of providing a generator operably engaged with the wheel train, wherein the speed-regulating device includes an electronic circuit, driven by electric power generated by the generator, that regulates the speed of rotation of the wheel train by controlling a period of rotation of the generator.

17. A method according to claim 15, further comprising the steps of providing a barrel drum having a barrel gear operably engaged with the mainspring, and mounting the second hand wheel and the barrel gear so as to overlap each other.

18. A method of making a timepiece, comprising the steps of:

providing a mainspring;

providing a second hand;

providing a wheel train operably engaged with the mainspring and comprising a plurality of wheels including a second the second hand is mounted, the second hand wheel including a pinion and a gear;

rotatably mounting the pinion and the gear about the same axis of rotation;

providing a generator that is driven by the wheel train, the generator including a coil; and providing a speed-regulating device that controls a period of rotation of the generator to regulate a speed of rotation of the wheel train;

wherein the second hand is disposed so that torque of the mainspring is transmitted to the speed-regulating device; and wherein the wheel train is disposed so as not to overlap the coil of the generator.

19. A method according to claim 15, further comprising the step of providing the second hand wheel with a pitch circle diameter of at least 1.5 mm.

20. A method according to claim 18, further comprising the step of providing the second hand wheel with a pitch circle diameter of at least 1.5 mm.

21. A method according to claim 17, further comprising the steps of providing a main plate, and supporting the barrel drum in a cantilever fashion to the main plate.

22. A method according to claim 18, further comprising the steps of providing a barrel drum having a barrel gear operably engaged with the mainspring, and mounting the second hand wheel and the barrel gear so as to overlap each other.

23. A method according to claim 15, further comprising the steps of:

providing a generator including a rotor driven by the wheel train, the plurality of wheels of the wheel train forming a torque transmission path between the mainspring and the generator;

providing a main plate;

providing a first wheel train bridge;

providing a second wheel train bridge disposed between the main plate and the first wheel train bridge;

providing an intermediate wheel and disposing it so that it is operably engaged with, and disposed closer to the generator in the torque transmission path than, the second hand wheel; and axially supporting the intermediate wheel between the first and second wheel train bridges.

24. A method according to claim 18, wherein the generator includes a rotor driven by the wheel train, the plurality of wheels of the wheel train forming a torque transmission path between the mainspring and the generator, the method further comprising the steps of:

providing a main plate;

providing a first wheel train bridge;

providing a second wheel train bridge disposed between the main plate and the first wheel train bridge;

providing an intermediate wheel and disposing it so that it is operably engaged with, and disposed closer to the generator in the torque transmission path than, the second hand wheel; and axially supporting the intermediate wheel between the first and second wheel train bridges.

25. A method according to claim 23, wherein the plurality of wheels includes a rotor wheel operably engaged with the rotor of the generator, and a second intermediate wheel, and wherein the method further comprises the steps of disposing the second intermediate wheel closer to the mainspring in the torque transmission system path than the rotor wheel, and axially supporting the second intermediate wheel between the second wheel train bridge and the main plate.

26. A method according to claim 24, wherein the plurality of wheels comprises a rotor wheel operably engaged with the rotor of the generator, and a second intermediate wheel, and wherein the method further comprises the steps of disposing the second intermediate wheel closer to the mainspring in the torque transmission system path than the rotor wheel, and axially supporting the second intermediate wheel between the second wheel train bridge and the main plate.

27. A timepiece, comprising:

spring means for generating rotational motion;

second hand means for indicating time in second increments;

torque transmitting means operably engaged with the spring means for transmitting torque developed by the spring means, the torque transmitting means comprising a plurality of wheel means including second hand wheel means for supporting the second hand means, the second hand wheel means including pinion means and gear means, each of which is rotatably mounted about the same axis of rotation and the gear means being disposed so as not to overlap the spring means; and means for regulating the speed of rotation of the torque transmission means;

wherein the second hand means is disposed so that torque of the spring means is transmitted to the speed regulating means.

28. A timepiece according to claim 27, further comprising generating means operably engaged with the torque transmission means, for producing rotational motion for generating electric power, wherein the speed regulating means includes electronic circuit means, driven by the electric power generated by the generating means, for regulating the speed of rotation of the torque transmission means by controlling a period of rotation of the generating means.

29. A timepiece according to claim 27, further comprising barrel drum means having barrel gear means operably engaged with the spring means, wherein the second hand wheel means and the barrel gear means are mounted so as to overlap each other.

30. A timepiece, comprising:

spring means for generating rotational motion;

second hand means for indicating time in second increments;

torque transmitting means operably engaged with the spring means for transmitting torque developed by the spring means, the torque transmitting means comprising a plurality of wheel means including second hand wheel means for supporting the second hand means, the second hand wheel means including pinion means and gear means, each of which is rotatably mounted about the same axis of rotation;

generating means for receiving a rotational force from the torque transmitting means, the generating means including inductive means; and means, including electronic circuit means, for controlling a period of rotation of the generating means for regulating a speed of rotation of the torque transmission means;

wherein the second hand means is disposed so that torque of the spring means is transmitted to the speed regulating means; and wherein the torque transmitting means is disposed so as not to overlap the inductive means.

31. A timepiece according to claim 27, wherein a pitch circle diameter of the second hand wheel means is at least 1.5 mm.

32. A timepiece according to claim 30, wherein a pitch circle diameter of the second hand wheel means is at least 1.5 mm.

33. A timepiece according to claim 29, further comprising main plate means for supporting the barrel drum means in a cantilever fashion.

34. A timepiece according to claim 30, further comprising barrel drum means having barrel gear means operably engaged with the spring means, wherein the second hand wheel means and the barrel gear means are mounted so as to overlap each other.

35. A timepiece according to claim 27, further comprising:

generating means including rotor means for receiving a rotational force from the torque transmitting means, the plurality of wheel means of the torque transmitting means forming a torque transmission path between the spring means and the generating means;

idle wheel means operably engaged with, and disposed closer to the generating means in the torque transmission system path than, the second hand wheel means;

main plate means; and first and second support means, disposed on the same side of the main plate means, for axially supporting the idle wheel between the first and second support means.

36. A timepiece according to claim 30, wherein the generating means includes rotor means for receiving a rotational force from the torque transmitting means, the plurality of wheels means of the torque transmitting means forming a torque transmission path between the spring means and the generating means, the timepiece further comprising:

idle wheel means operably engaged with, and disposed closer to the generating means in the torque transmission system path than, the second hand wheel means;

main plate means; and first and second support means, disposed on the same side of the main plate means, for axially supporting the idle wheel between the first and second support means.

37. A timepiece according to claim 35, wherein the plurality of wheel means comprises rotor wheel means operably engaged with the rotor means, and intermediate wheel means located closer to the spring means in the torque transmission path than the rotor wheel means, the intermediate wheel means being axially supported between the second support means and the main plate means.

38. A timepiece according to claim 36, wherein the plurality of wheel means comprises rotor wheel means operably engaged with the rotor means, and intermediate wheel means located closer to the spring means in the torque transmission path than the rotor wheel means, the intermediate wheel means being axially supported between the second support means and the main plate means.

* * * * *

UNITED STATES PATENT AND TRADEMARK OFFICE

CERTIFICATE OF CORRECTION

PATENT NO. : 6,367,966 B1
DATED : April 9, 2002
INVENTOR(S) : Tatsuo Hara

It is certified that error appears in the above-identified patent and that said Letters Patent is hereby corrected as shown below:

Column 14,
Line 57, correct “where in” to -- wherein --.
Line 59, correct, “t o” to -- to --.

Column 15,
Line 42, insert -- hand wheel to which -- after “second”.

Signed and Sealed this

Fifth Day of November, 2002

*Attest:*

*Attesting Officer*

JAMES E. ROGAN
*Director of the United States Patent and Trademark Office*